United States Patent [19]

Schmetz et al.

[11] Patent Number: 4,634,103

[45] Date of Patent: Jan. 6, 1987

[54] OVEN EQUIPMENT FOR COOLING A CHARGE AFTER THERMAL TREATMENT

[75] Inventors: Peter Schmetz, Menden; Dieter Gierse, Werdohl, both of Fed. Rep. of Germany

[73] Assignee: Schmetz GmbH, Menden, Fed. Rep. of Germany

[21] Appl. No.: 621,524

[22] Filed: Jun. 18, 1984

[30] Foreign Application Priority Data

Jun. 22, 1983 [DE] Fed. Rep. of Germany ..... 3322386

[51] Int. Cl.[4] ..... C21D 9/00; C21D 11/00

[52] U.S. Cl. ..... 266/80; 266/87; 266/250; 266/259

[58] Field of Search ..... 266/250, 259, 251, 249, 266/46, 80, 87, 90

[56] References Cited

U.S. PATENT DOCUMENTS 4,195,820 4/1980 Berg ..... 266/250

FOREIGN PATENT DOCUMENTS 3208574 9/1983 Fed. Rep. of Germany ..... 266/250

330202 4/1972 U.S.S.R. ..... 266/259

*Primary Examiner*—Christopher W. Brody

*Attorney, Agent, or Firm*—Becker & Becker, Inc.

[57] ABSTRACT

A method and oven equipment for cooling a charge after thermal treatment. The charge, which is located within a closed chamber, is cooled by blowing in cooling gas. The cooling occurs as a function of the actual conditions of the charge at a predetermined speed, and a uniform distribution of temperature within the charge is assured. For this purpose, the temperature distribution in the charge is measured by temperature sensors, and the intensity and/or direction of the flow of the cooling gas can be changed if deviations from the predetermined theoretical values occur. The wall of the closed treatment chamber of the oven equipment contains a plurality of gas passages which can either be closed off, or are permeable for gases yet impermeable for heat rays. Cooling gases are conducted through the chamber via control valves. The cooling gas is circulated with the aid of a blower unit along with a gas cooler. A temperature control system based on desired-actual-comparisons operates the control valves and the closure elements of the gas passages.

4 Claims, 18 Drawing Figures

FIG-3a
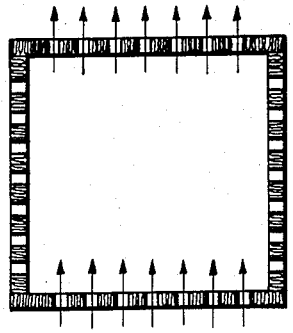
FIG-3b
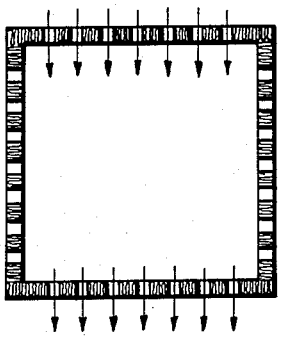
FIG-3c
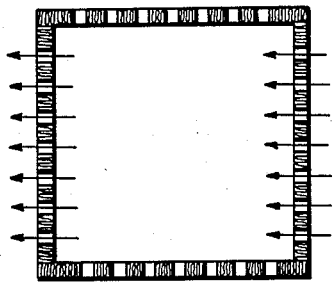
FIG-3d
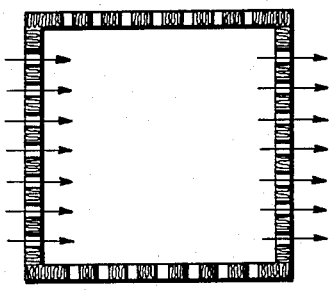
FIG-3e
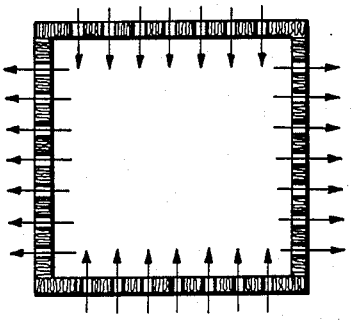
FIG-3f
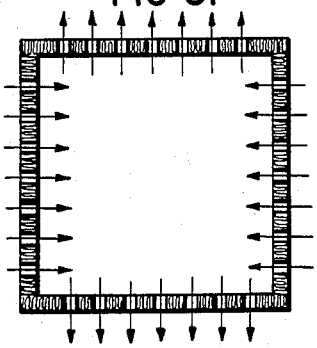
FIG-3g
CONTROL VALVES
| OPERATING STATES FIG-3 | A7 | E7 | E9 | A10 | A9 | E10 | A6 | E6 |
|---|---|---|---|---|---|---|---|---|
| a | 1 | 0 | 0 | 0 | 0 | 0 | 0 | 1 |
| b | 0 | 1 | 0 | 0 | 0 | 0 | 1 | 0 |
| c | 0 | 0 | 0 | 0 | 1 | 1 | 0 | 0 |
| d | 0 | 0 | 1 | 1 | 0 | 0 | 0 | 0 |
| e | 0 | 1 | 0 | 1 | 1 | 0 | 0 | 1 |
| f | 1 | 0 | 1 | 0 | 0 | 1 | 1 | 0 |

FIG-4a
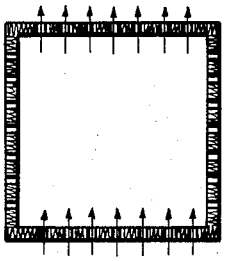
FIG-4b
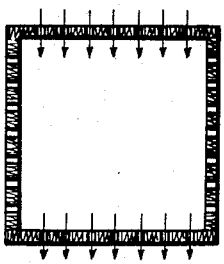
FIG-4c
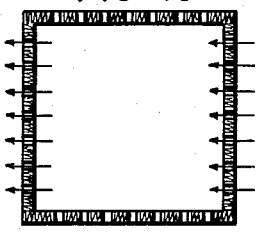
FIG-4d
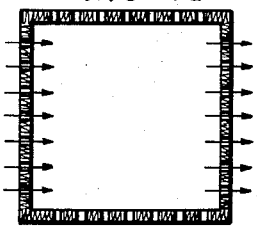
FIG-4e
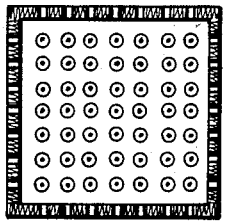
FIG-4f
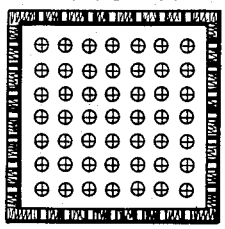
FIG-4g
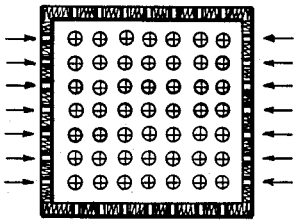
FIG-4h
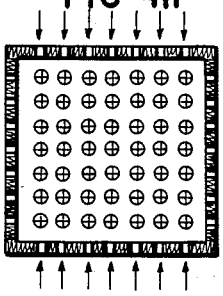
FIG-4i
CONTROL VALVES
| OPERATING STATES FIG-4 | E19 | A19 | E18 | A18 | E20 | A20 | E21 | A22 | A21 | E22 | E23 | A23 |
|---|---|---|---|---|---|---|---|---|---|---|---|---|
| a | 0 | 0 | 0 | 0 | 0 | 0 | 0 | 0 | 1 | 1 | 0 | 0 |
| b | 0 | 0 | 0 | 0 | 0 | 0 | 1 | 1 | 0 | 0 | 0 | 0 |
| c | 0 | 0 | 0 | 0 | 1 | 0 | 0 | 0 | 0 | 0 | 0 | 1 |
| d | 0 | 0 | 0 | 0 | 0 | 1 | 0 | 0 | 0 | 0 | 1 | 0 |
| e | 1 | 0 | 0 | 1 | 0 | 0 | 0 | 0 | 0 | 0 | 0 | 0 |
| f | 0 | 1 | 1 | 0 | 0 | 0 | 0 | 0 | 0 | 0 | 0 | 0 |
| g | 0 | 1 | 0 | 1 | 1 | 0 | 0 | 0 | 0 | 0 | 1 | 0 |
| h | 0 | 1 | 0 | 1 | 0 | 0 | 1 | 0 | 0 | 1 | 0 | 0 |

OVEN EQUIPMENT FOR COOLING A CHARGE AFTER THERMAL TREATMENT

BACKGROUND OF THE INVENTION

1. Field of the Invention

The present invention relates to a method of cooling a charge or batch, especially of metal workpieces, after thermal treatment within a closed chamber by blowing in a cooling gas. The present invention also relates to oven or kiln equipment for carrying out such a method.

2. Description of the Prior Art

For a long time, the "new" method of so-called vacuum hardening has been a conventional method for hardening metallic workpieces. This method essentially comprises heating the material which is to be treated (the charge) under vacuum to the required hardening temperature, and subsequently quenching the charge by blowing in a cooling gas, such as nitrogen or argon. The advantages which such a method offers, especially with regard to the surface quality of the hardened material, however, cannot be utilized if the quenching process within the charge takes place so non-uniformly that greatly differing hardness values result therefrom, or if on an individual piece, which is being handled, notable temperature differences occur between different spots of the piece being treated, which can lead to permanent changes in shape (distortion). Such shortcomings can be intensified if the individual parts being treated, or the entire charge, have different mass distributions, or if, due to the build-up of the charge, the flow through of cooling gas is obstructed.

It is an object of the present invention, for cooling a charge subsequent to thermal treatment within a closed chamber of oven equipment by blowing in cooling gas, to develop a method which offers the possibility of allowing the cooling of a charge to take place as a function of the actual conditions at a predetermined velocity, and according to which at the same time it is possible to maintain a uniform temperature distribution within the charge.

It is a further object of the present invention to provide oven or kiln equipment for carrying out such a method.

BRIEF DESCRIPTION OF THE DRAWINGS

These objects, and other objects and advantages of the present invention, will appear more clearly from the following specification in conjunction with the accompanying drawings, in which:

FIGS. 3*a*–3*g* illustrate, schematically and by way of a table, the different operating states regarding the flow of cooling gas in the treatment chamber of che oven equipment of FIG. 1; and FIGS. 4*a*–4*i*, schematically and by way of a table, illustrate the different operating states regarding the flow of cooling gas in the treatment chamber of the oven equipment of FIG. 2.

SUMMARY OF THE INVENTION

Figure 1:
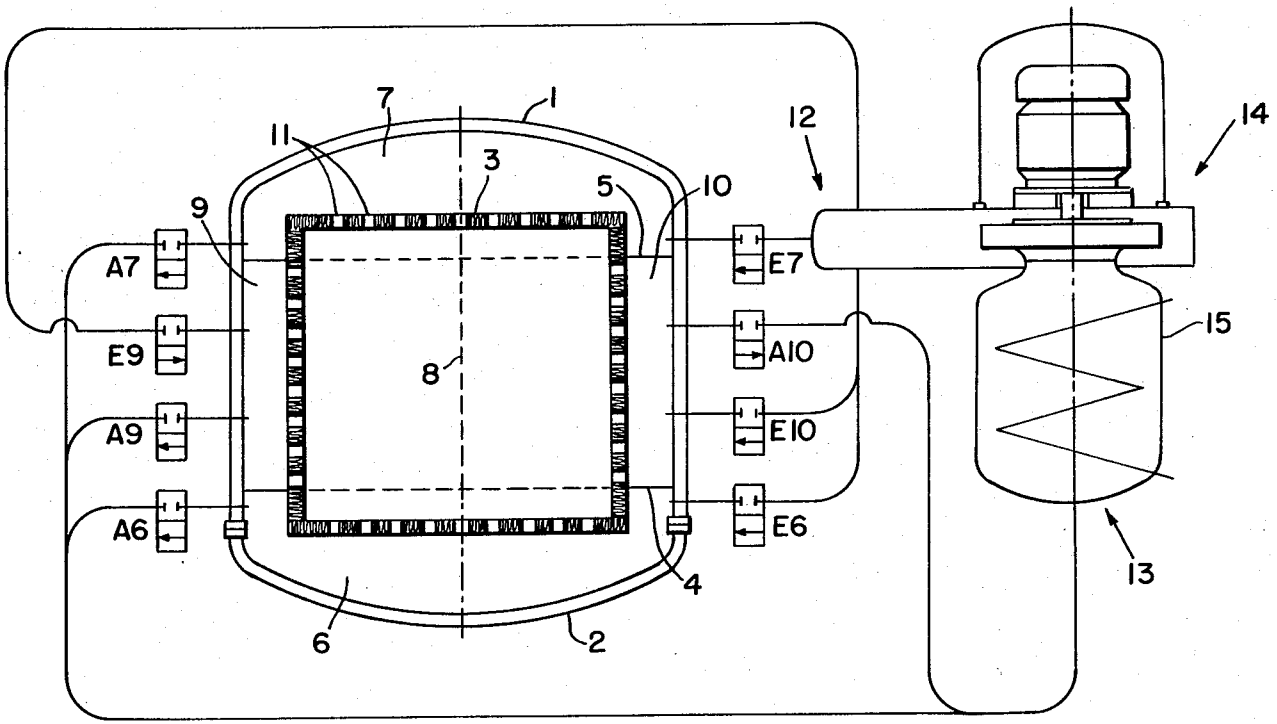
FIG. 1 is a diagrammatic illustration of one inventive embodiment of oven equipment having a cylindrical treatment chamber.

The method of the present invention is characterized primarily by measuring the temperature distribution in the charge by means of temperature sensors such as thermocouple elements or the like, and by changing the intensity and/or direction of the flow of cooling gas for achieving a desired cooling velocity as well as for a substantially uniform temperature distribution in the charge when deviations from the predetermined theoretical values for the measured temperature are encountered.

The oven or kiln equipment of the present invention for carrying out such a method, if it has a cylindrical treatment chamber, along with a blower unit, is characterized primarily by the following features:

The chamber has an upright cylinder axis and is concentrically disposed in a closed cylindrical housing with space on all sides;

in the annular space between the chamber and the housing there are partitions disposed at right angles to the walls of the chamber and the housing; some of these partitions are in the vicinity of the upper end and lower end of the chamber, and others of these partitions are in an axial plane between the lower and upper partitions, so that a respective closed-off chamber is formed above and below the chamber, and two further closed-off chambers are formed around the chamber;

the walls of the chamber contain a plurality of gas passages which can either be closed off, or are permeable for gases yet impermeable for heat rays;

two pipe connections for the introduction and withdrawal of cooling gas are associated with each of the four chambers and are disposed in the wall of the housing;

one of the connections of each of the spaces is connected via a connecting line and a control valve to the pressure side of the blower unit for cooling gas, and the second connection of each of the spaces is connected via a connecting line and a control valve to the suction side of the blower unit for cooling gas; and a temperature control system, which operates on the basis of desired-actual-comparisons between the theoretical values of the preset temperatures and the measured actual values, serves to operate the control valves and the closure elements of the gas passages.

Alternatively, the oven or kiln equipment of the present invention, if it has a cubical treatment chamber, along with a blower unit, is characterized primarily by the following features:

The treatment chamber is disposed in a closed cylindrical housing having a horizontal cylinder axis, and is spaced from the ends of the housing;

in the vicinity of the four walls of the chamber, which walls extend in the direction of the cylinder axis of the housing, and in the vicinity of the ends of the walls, partitions are arranged which span the space between these four walls and the housing, so that closed-off chambers are respectively formed between each wall of the treatment chamber and the inner wall of the housing;

the walls of the treatment chamber contain a plurality of gas passages which can either be closed off, or are permeable for gases yet impermeable for heat rays;

two pipe connections for the introduction and withdrawal of cooling gas are associated with each of the six chambers in the wall of the housing;

for each of the chambers, one of the connections is connected via a connecting line and a control valve to the pressure side of the blower unit for cooling gas, and the second connection is connected via a connecting line and a control valve to the suction side of the blower unit for cooling gas; and a temperature control system, which operates on the basis of desired-actual-comparisons between the theoretical values of the preset temperatures and the measured actual values, serves to operate the control valves and the closure elements of the gas passages.

To treat a number of uniform charges, it is advantageous to include an electrical register in the temperature control system for storing the control signals of a first charge for a programmed control of repeat charges.

The advantages achieved with the present invention consist essentially in that, due to the directed introduction of the cooling gas in the treatment chamber with regard to intensity and/or direction while taking into consideration the actual conditions of the charge, on the one hand, the cooling can be carried out at a predetermined speed, and, on the other hand, a substantially uniform distribution of the temperature within the charge can be obtained. In this connection, uniform temperature distribution implies keeping the temperature differences within a predetermined range. Furthermore, the oven or kiln equipment proposed pursuant to the present invention makes possible, for the various conventional designs of treatment chambers, a reliable implementation of the aforementioned method steps. The inclusion of a temperature control system, which operates on the basis of desired-actual-comparisons between the theoretical values of the preset temperatures and the measured actual values, furthermore offers the advantage of being able automatically to carry out the entire cooling process.

DESCRIPTION OF PREFERRED EMBODIMENTS

Referring now to the drawings in detail, the oven or kiln equipment illustrated in FIG. 1 is in the form of a vacuum chamber oven, and essentially comprises a double-walled cylindrical steel housing 1, on the under side of which there are provided a removable cover 2, and a cylindrical treatment chamber 3 located within the housing 1. The treatment chamber 3 has an upright cylinder axis, and on all sides has space between it and the inner wall of the housing 1. Charging of the oven is effected from below by removing the cover 2. This cover could just as well be disposed at the top of the steel housing.

Partitions 4 and 5 in the form of annular disks are disposed in the space between the treatment chamber 3 and the steel housing 1 in the vicinity of the upper and lower end of the chamber 3. As a result of these partitions 4, 5, a lower chamber 6, an upper chamber 7, and a central chamber are formed in the aforementioned space. The central chamber is divided into two chambers 9, 10, each of which is semi-cylindrical, by two partitions 8, which are disposed in a common axial plane.

The bottom, the top, and the cylinder wall of the treatment chamber 3 respectively contain a plurality of gas passages 11, which are either permeable for gases and impermeable for heat rays, or can be closed off by non-illustrated valves or the like. Control units, such as lifting cylinders or the like, serve to operate these valves. Two pipe connections, for the introduction and withdrawal of cooling gas, open into each of the chambers 6, 7, 9, and 10. These pipe connections are connected via connecting lines and respective control valves either to the pressure side 12 or to the suction side 13 of a blower unit 14. On the suction side, a gas cooler 15 is connected ahead of the blower unit 14.

The control valves for introduction of cooling gas include the reference letter E, while the control valves for the withdrawal cooling gas include the reference letter A; the control valves also include additional reference numerals showing with which chamber 6, 7, 9, or 10 they are associated. The control valves are two-way valves, and are actuated electromagnetically or in some other manner.

With a treatment chamber 3 designed in this manner, six different operating states or conditions can be obtained with regard to directing the cooling gas within the chamber 3. These operating states or conditions are illustrated in FIGS. *3a–3f*, with the table of FIG. *3g* indicating, for each operating state or condition, the switch positions of all eight of the control valves. In this connection, I indicates an open valve, and O indicates a closed valve.

Figure 2:
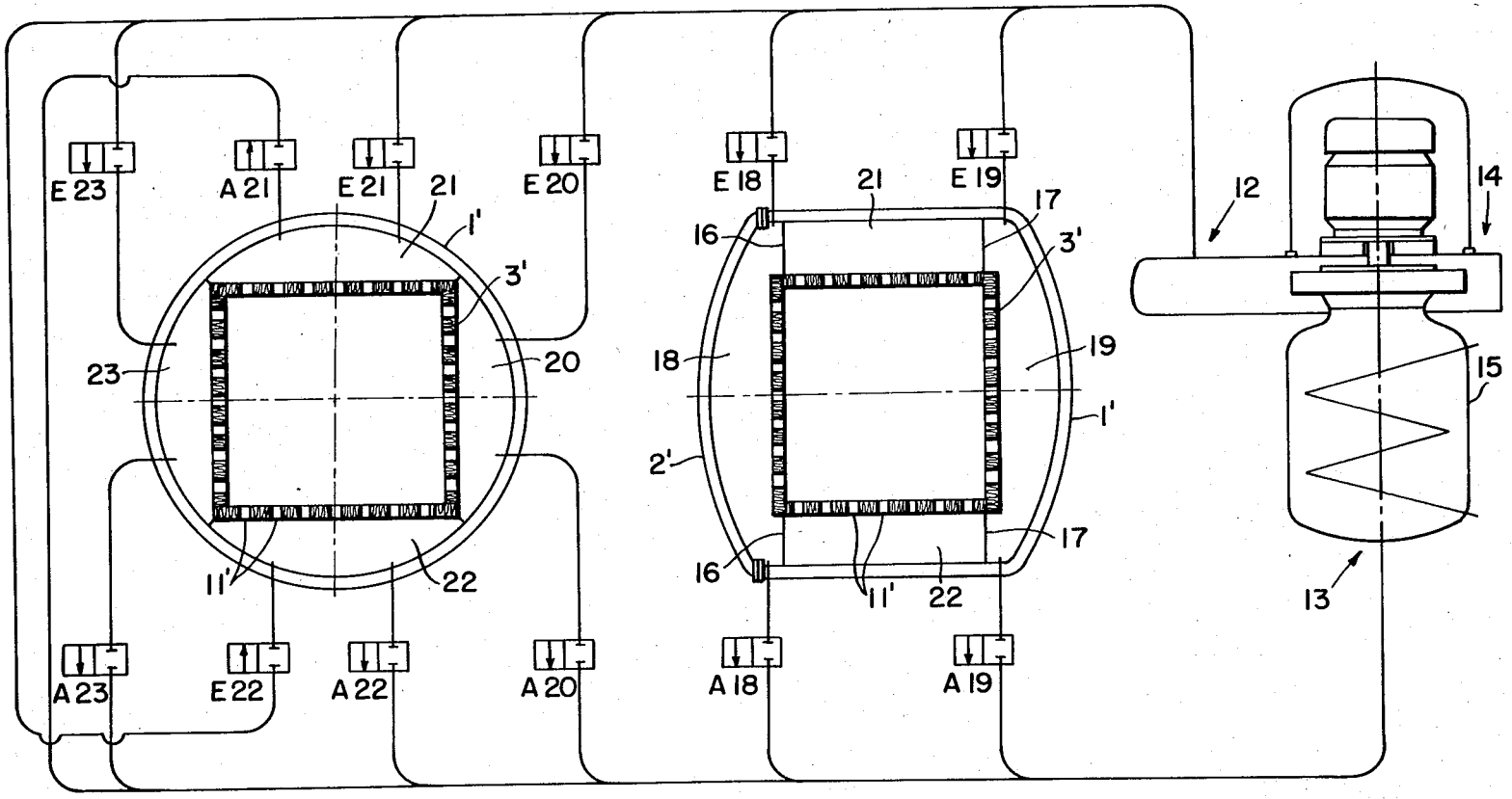
FIG. 2 is a diagrammatic illustration of another inventive embodiment of oven equipment having a cubical treatment chamber.

FIG. 2 shows an oven or kiln equipment having a cubical treatment chamber 3' in a cylindrical steel housing 1', which is disposed in such a way as to have a horizontal cylinder axis. The cover 2', which closes the charging opening, in this embodiment is located on one of the end faces.

In the diagrammatic illustration ot FIG. 2, the steel housing 1' is shown at the left in cross section and at the right in longitudinal section. The length of the diagonals of the cubical treatment chamber 3' correspond approximately to the inner diameter of the cylindrical steel housing 1'. Partitions 16, 17 in the shape of segments of a circle are disposed in the space between the treatment chamber 3' and the steel housing 1'in the vicinity of the ends of the chamber 3', when viewed in the direction of the cylinder axis, and on each of the four walls of the chamber 3'. A total of six closed-off chambers is formed by these partitions 16, 17; namely a chamber 18, 19 on each of the ends, and the chambers 20, 21, 22, and 23 on the longitudinal walls of the chamber 3'.

With this embodiment also, two pipe connections for the introduction and withdrawal of cooling gas open into each of the chambers. These pipe connections are connected via control valves and connecting lines either to the pressure side 12 or to the suction side 13 of a blower unit 14 which is provided with a gas cooler 15. Plural gas passages 11' are provided in all six of the walls of the treatment chamber 3'. These gas passages 11' are either permeable for gas and impermeable for heat rays, or can be closed off by non-illustrated closure elements.

As previously described in connection with the oven equipment of FIG. 1, the control valves for the equipment pursuant to FIG. 2 are designated with the reference letters E and A followed by a reference numeral which coincides with the reference numeral of the associated chamber.

With the cubical treatment chamber 3', eight different operating states or conditions are possible with regard to directing the cooling gas within the chamber 3'. These different operating states or conditions are illustrated in FIGS. *4a–4h* in the same manner as was done in FIGS. *3a–3f* for the oven equipment of FIG. 1. In the operating states of FIGS. *4e–4h*, gas flows can be set which extend in opposite directions at right angles to the plane of the drawing. This is indicated by crosses or dots. The table of FIG. *4i* shows the switch positions of the twelve control valves for all eight of the operating states or conditions.

The intensity of the different flows of the cooling gas within the treatment chambers 3 or 3' can be changed in a simple manner by regulating the delivery of the blower unit 14.

The present invention is, of course, in no way restricted to the specific disclosure of the specification and drawings, but also encompasses any modifications within the scope of the appended claims.

What we claim is:

1. Oven equipment for cooling thermally treated metal charges or workpieces hardened by heat after thermal treatment within a closed chamber and quenched by blowing in a cooling gas to allow cooling of the charges to take place as a function of actual conditions at a predetermined velocity while at the same time making possible maintenance of a uniform temperature distribution within the charge to avoid distortion and greatly differing hardness values resulting therefrom due to different mass distributions and due to temperature differences between different spots of workpieces being treated comprising:

a closable cylindrical housing having a cylinder wall and two end walls;

a cylindrical treatment chamber having a cylinder wall, two end walls, and an upright cylinder axis; said treatment chamber being concentrically disposed in said housing in such a way that space is provided on all sides of said treatment chamber between the latter and said walls of said housing, namely an annular space around said cylinder wall of said treatment chamber, and spaces at each of said end walls thereof; said cylinder wall and said end walls of said treatment chamber being provided with a plurality of gas passages which are either adapted to be closed off, or are permeable for gases and impermeable for heat rays;

a first partition, which extends in said annular space around said treatment chamber at right angles from said cylinder wall of said treatment chamber to said cylinder wall of said housing, and is disposed in the vicinity of the bottom end of said treatment chamber, to form a first closed-off chamber below said treatment chamber;

a second partition, which extends in said annular space around said treatment chamber at right angles from said cylinder wall of said treatment chamber to said cylinder wall of said housing, and is disposed in the vicinity of the top end of said treatment chamber, to form a second closed-off chamber above said treatment chamber;

two third partitions, each of which extends in said annular space around said treatment chamber at right angles from said cylinder wall of said treatment chamber to said cylinder wall of said housing, between said first and second partitions, and in a single axial plane, which coincides with said cylinder axis of said treatment chamber, to form two third closed-off chambers around said cylinder wall of said treatment chamber;

for each of said four closed-off chambers, a respective first pipe connection in said walls of said housing for introducing cooling gas into said chambers;

for each of said four closed-off chambers, a respective second pipe connection in said walls of said housing for withdrawing cooling gas from said chambers;

a blower unit, for cooling gas, having a pressure side and a suction side;

a respective connecting line and control valve for connecting each first pipe connection of a given closed-off chamber to said pressure side of said blower unit;

a respective connecting line and control valve for connecting each second pipe connection of a given closed-off chamber to said suction side of said blower unit; and a temperature control system which operates on the basis of desired-actual-comparisons between the theoretical values of preset temperatures and measured actual temperature values of temperature distribution in respective charges; said system serving to operate said control valves and, as the case may be, closure elements for said gas passages of said walls of said treatment chamber for changing at least one of the intensity and direction of flow of said cooling gas as a function of deviations of the measured temperature values from predetermined theoretical values for said temperatures in order to achieve a desired cooling speed and to achieve substantially uniform temperature distribution in said charges respectively for uniform hardening thereof.

2. Oven equipment according to claim 1, which includes an electrical register for storing control signals of a first charge for a programmed control of repeat charges.

3. Oven equipment for cooling thermally treated metal charges or workpieces hardened by heat after thermal treatment within a closed chamber and quenched by blowing in a cooling gas to allow cooling of the charges to take place as a function of actual conditions at a predetermined velocity while at the same time making possible maintenance of a uniform temperature distribution within the charge to avoid distortion and greatly differing hardness values resulting therefrom due to different mass distributions and due to temperature differences between different spots of workpieces being treated comprising:

a closable cylindrical housing having a cylinder wall, two end walls, and a horizontal cylinder axis;

a cubical treatment chamber having two end walls facing said end walls of said housing, and four side walls the planes of which are parallel to said cylinder axis of said housing; said treatment chamber being disposed in said housing in such a way that space is provided between said end walls of said treatment chamber and said housing, and at least in part between said side walls of said treatment chamber and said cylinder wall of said housing; said side walls and said end walls of said treatment chamber being provided with a plurality of gas passages which are either adapted to be closed off, or are permeable for gases and impermeable for heat rays;

two partitions on all four of said side walls of said treatment chamber, one near each end of said side walls in the vicinity of said end walls of said treatment chamber; said partitions span said space between said housing and said treatment chamber so as to form six closed-off chambers, one between each wall of said treatment chamber and said walls of said housing;

for each of said six closed-off chambers, a respective first pipe connection in said walls of said housing for introducing cooling gas into said chambers;

for each of said six closed-off chambers, a respective second pipe connection in said walls of said housing for withdrawing cooling gas from said chambers;

a blower unit, for cooling gas, having a pressure side and a suction side;

a respective connecting line and control valve for connecting each first pipe connection of a given closed-off chamber to said pressure side of said blower unit;

a respective connecting line and control valve for connecting each second pipe connection of a given closed-off chamber to said suction side of said blower unit; and a temperature control system which operates on the basis of desired-actual-comparisons between the theoretical values of preset temperatures and measured actual temperature values of temperature distribution in respective charges; said system serving to operate said control valves and, as the case may be, closure elements for said gas passages of said walls of said treatment chamber for changing at least one of the intensity and direction of flow of said cooling gas as a function of deviations of the measured temperature values from predetermined theoretical values for said temperatures in order to achieve a desired cooling speed and to achieve substantially uniform temperature distribution in said charges respectively for uniform hardening thereof.

4. Oven equipment according to claim 3, which includes an electrical register for storing control signals of a first charge for a programmed control of repeat charges.

* * * * *